US007445175B2

(12) United States Patent
Leyden et al.

(10) Patent No.: US 7,445,175 B2
(45) Date of Patent: Nov. 4, 2008

(54) METHOD AND APPARATUS FOR WRAPPING CORD AROUND A REEL

(75) Inventors: Roger Leyden, Inverness, IL (US); Kris Michael Southerland, Palatine, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 265 days.

(21) Appl. No.: 11/174,752

(22) Filed: Jul. 5, 2005

(65) Prior Publication Data

US 2007/0007379 A1 Jan. 11, 2007

(51) Int. Cl.
*B65H 75/48* (2006.01)

(52) U.S. Cl. ..... 242/375.1; 242/372

(58) Field of Classification Search ..... 242/371, 242/372, 375, 375.1; 267/272, 158, 157, 267/26, 154, 155, 273, 285; 185/37, 39, 185/40 R, 45, 9, 10, 11; 160/170, 171
See application file for complete search history.

(56) References Cited

U.S. PATENT DOCUMENTS 2,869,801 A * 1/1959 Foster ..... 242/372
6,305,632 B1 * 10/2001 Hwang ..... 242/378.1
RE37,590 E * 3/2002 Leyden et al. ..... 340/568.1
6,745,969 B1 * 6/2004 Gouda ..... 242/375
6,766,588 B1 * 7/2004 Hsu ..... 33/755

* cited by examiner

*Primary Examiner*—Peter M. Cuomo
*Assistant Examiner*—William E Dondero
(74) *Attorney, Agent, or Firm*—Wood, Phillips, Katz, Clark & Mortimer

(57) ABSTRACT

An apparatus for drawing a flexible cord into a wrapped configuration around a reel. The apparatus has a housing and a reel that is movable around a first axis relative to the housing. The apparatus further includes a spring system through which a rotational force is exerted on the reel tending to rotate the reel around the first axis to thereby cause a flexible cord associated with the reel, that is drawn away from the housing by turning of the reel in one direction around the first axis, to be wrapped around the reel by turning of the reel oppositely to the one direction around the first axis. The spring system permits a user to selectively vary at least one of a) the nature and b) the magnitude of the rotational force exerted on the reel.

35 Claims, 6 Drawing Sheets

METHOD AND APPARATUS FOR WRAPPING CORD AROUND A REEL

BACKGROUND OF THE INVENTION

1. Field of the Invention

This invention relates to cords that are mechanical and/or electrical in nature and, more particularly, to a method and apparatus for wrapping the cord around a reel, as for purposes of wire management.

2. Background Art

There are myriad different environments in which flexible cords are used. In certain applications, a cord of a specific maximum length is required. However, the particular object at the end of the cord may be used in a manner that the full length of the cord is not required. In those instances when less than the full length of the cord is demanded, it is desirable that the unused length thereof be controlled so that it does not hamper use of the associated object, tangle, or otherwise interfere in the particular environment.

In some environments, such as at a point-of-purchase display wherein security systems with many cords associated with a plurality of objects are used, the ability to "manage" these cords is critical. In the absence of some "wire management" capability, these systems may become difficult to use, potentially to the point of being impractical.

In the security industry, a number of mechanisms have been devised for rewinding cords, for purposes of wire management. These rewinding mechanisms are used on security cords that are both electrical and mechanical in nature.

In a purely mechanical system, a cord that is resistant to being cut is wound in a housing. The free end of the cord is attached, through any of a number of end connectors, to an object being monitored. A reel within the housing, about which the cord is wound, is normally biased in rotation in such a manner as to draw the cord back into the housing. The potential purchaser is allowed to pick up the object that is tethered through the cord and pull the same against a winding force produced on the reel. Once the force generated by the user is released, the cord is retracted up to a point that the object can be placed in a convenient display position.

The assignee herein is the owner of U.S. Pat. No. Re. 37,590, which is directed to a system for rewinding a cord that is integrated into an electrical circuit for monitoring portable articles. Systems made according to this invention have been highly commercially successful in terms of their wire management capabilities. Utilizing the structure in U.S. Pat. No. Re. 37,590, an electronic alarm system can be incorporated to alert systems operators of a breach. An object with which the end of the cord is associated can be repositioned within a range dictated by the length of the cord against a withdrawing force tending to rewind the cord upon a reel. As with the aforementioned mechanical cord, the object associated therewith can be repositioned by a potential consumer and thereafter replaced on a display, as an incident of which the cord will be rewound to minimize the presence of cord that is prone to tangling with other cords or system components.

Flexible cords are used in many other environments that vary in terms of the nature of the article associated with the end of the cord and its size and weight. The nature of the article will also dictate the requirements of the cord both in an electrical and mechanical sense.

Consequently, the mechanisms that rewind cords must often be customized based on the particular environment. In some applications, a relatively strong rewinding force on the cords is required, whereas in other applications, a significantly lesser force is appropriate. Even in a single application, different winding characteristics may be called for and may have to be balanced on a case-by-case basis. As just one example, certain consumer articles and displays are such that it is appropriate to allow the articles thereon to be moved by a potential consumer within a substantial range so as to be operated or to allow inspection. At the same time, it is desirable that the cord be positively withdrawn with a force that does not cause it to be pulled out of a user's grasp or pulled with an excessive force back to a display position. A given display may have articles with different sizes and weights calling for different cord rewinding forces and capabilities.

Consequently, these rewinding mechanisms have generally been customized based on the specific application. On a mass production basis, this generally requires that assembly lines be dedicated to making specific products based upon the requisite rewinding force. This is an inconvenience in terms of both manufacturing and inventory control, both at point of manufacture and potentially for the end user.

SUMMARY OF THE INVENTION

In one form, the invention is directed to an apparatus for drawing a flexible cord into a wrapped configuration around a reel. The apparatus has a housing and a reel that is movable around a first axis relative to the housing. The apparatus further includes a spring system through which a rotational force is exerted on the reel tending to rotate the reel around the first axis to thereby cause a flexible cord associated with the reel, that is drawn away from the housing by turning of the reel in one direction around the first axis, to be wrapped around the reel by turning of the reel oppositely to the one direction around the first axis. The spring system permits a user to selectively vary at least one of a) the nature and b) the magnitude of the rotational force exerted on the reel.

The apparatus may be provided in combination with a flexible cord that is associated with the reel.

In one form, the springs are coiled springs and the spring system includes first and second spring modules that can be interchangeably mounted on the housing in operative relationship with the reel. The first and second spring modules have different spring force characteristics.

In one form, the spring system includes a spring support assembly that is mounted on the housing in operative relationship with the reel. The spring support assembly accommodates a plurality of springs that can be selectively operatively engaged to cause the spring system to exert a desired rotational force upon the reel.

In one form, the spring support assembly has X number receptacles each for one of the plurality of coiled springs. The spring system may further include a drive assembly that causes a rotational force developed by one or more coiled springs in the receptacles to be exerted on the reel.

In one form, selectively X number coiled springs or from 1-X number coiled springs can be operatively engaged with the drive assembly.

In one form, the spring support assembly has X number annular walls disposed around the first axis, each defining a receptacle to receive a coiled spring. The drive assembly includes a drive element that moves around the first axis and is keyed to the reel to transmit a rotational force to the reel.

In one form, the reel and drive element have cooperating connecting parts that can be engaged to make a keyed connection between the reel and drive element without requiring any separate fasteners.

In one form, the reel and drive element are engaged by being relatively moved in translation along the first axis.

In one form, the drive element has a body with a first connector and the spring system includes a first coiled spring in one of the receptacles having an end that is joined to the first connector to follow movement of the drive element around the first axis to thereby effect loading of the first coiled spring.

In one form, the drive element body has a second connector. The spring system further includes a second coiled spring in another of the receptacles and having an end that is joined to the second connector to follow movement of the drive element around the first axis.

In one form, the end of the first coiled spring is joined to the first connector by translating the end of the first coiled spring relative to the first connector along the first axis.

The support assembly may include a case having first and second joined parts bounding a chamber. An opening may be provided through the case. The spring system may further include a coiled spring and a drive assembly including a drive element that is keyed to the reel through the case opening for conjoint rotation therewith around the first axis. The coiled spring and drive element are captively located in the chamber between the first and second case parts.

In one form, the housing has first and second joined parts bounding a main chamber and the reel and support assembly reside in the main chamber and are captive between the first and second housing parts.

In one form, the case, coiled spring and drive assembly are part of a self-contained module that is mounted on the housing in operative relationship with the reel.

In one form, the self-contained module is releasably mounted in operative relationship with the reel by moving the self-contained module along the first axis relative to the reel.

The apparatus may be further provided in combination with a connector on the flexible cord that can be attached to an article to be restrained in movement relative to the housing by the flexible cord.

The apparatus may be provided in combination with an alarm system and a sensor that is attachable to a portable article to be monitored. The flexible cord defines a conductive path between the sensor and the alarm system. The alarm system is caused to generate a detectable alarm signal in the event that the conductive path is interrupted.

The apparatus may further include an article to which the sensor is connected so that disconnection of the sensor from the article causes the alarm system to generate a detectable alarm signal.

In one form, the reel has two chambers, and the flexible cord extends from the first chamber through the housing and to the sensor, and from the second chamber to the alarm system.

The invention is further directed to an apparatus for drawing a flexible cord into a wrapped configuration around a reel. The apparatus includes a housing, a reel that is movable around a first axis relative to the housing, and a spring system through which a rotational force is exerted on the reel tending to rotate the reel around the first axis to thereby cause a flexible cord associated with the reel, that is drawn away from the housing by turning of the reel in one direction around the first axis, to be wrapped around the reel by turning of the reel oppositely to the one direction around the first axis. The spring system has a first self-contained module having a case with an opening, a drive element movable around a second axis relative to the case, and at least one spring through which a rotational force can be exerted on the drive element to urge the drive element in movement around the second axis relative to the case. The self-contained module may be moved relative to the housing to make a keyed connection through the case opening between the drive element and reel.

In one form, the housing has first and second joinable parts that define a main chamber when joined, and the first self-contained module is captive between the first and second parts.

The first self-contained module and reel may be relatively movable along a line that is substantially parallel to the first and second axes to make a keyed connection between the drive element and reel.

In one form, the first self-contained module has first and second case parts that are joined to define a chamber within which the at least one spring and drive element are captively maintained between the first and second case parts.

The self-contained module may have a plurality of receptacles, each to receive a coiled spring, that can be operatively connected to the drive element.

In one form, there are X number receptacles. The drive element can be operatively connected to X number coiled springs. In one form, there are from 1-X number coiled springs operatively connected to the drive element.

A second self-contained module, like the first self-contained module, can be provided. The first and second self-contained modules can be interchangeably used to be operative with the reel.

In one form, the first and second self-contained modules have spring force characteristics that are different to thereby cause the at least one spring in the first self-contained module to cause a rotational force to be exerted on the reel that is different in at least one of a) nature and b) magnitude than a rotational force exerted on the reel by the at least one spring in the second self-contained module.

The housing may have releasably joined first and second parts bounding a main chamber in which the operative reel resides.

The apparatus may be provided in combination with a flexible cord that is associated with the reel.

The apparatus may be further provided in combination with a connector on the flexible cord that can be attached to an article to be restrained in movement relative to the housing by the flexible cord.

The apparatus may be further provided in combination with an alarm system and a sensor that is attachable to a portable article to be monitored. The flexible cord defines a conductive path between the sensor and the alarm system. The alarm system is caused to generate a detectable alarm signal in the event that the conductive path is interrupted.

The apparatus may be provided in combination with an article, with the sensor connected to the article so that disconnection of the sensor from the article causes the alarm system to generate the detectable alarm signal.

In one form, the reel comprises two chambers, and the flexible cord extends from the first chamber through the housing and to the sensor and from the second chamber to the alarm system.

The invention is further directed to a method of forming an apparatus for drawing a flexible cord into a wrapped configuration around a reel. The method includes the steps of: providing a housing with a reel that is movable around a first axis and having a flexible cord wrapped around the reel; selecting a first self-contained module, with a case and a drive element that can be urged in rotation around a second axis relative to the case by at least one spring with a first spring characteristic, from a plurality of self-contained modules including at least a second self-contained module that is the same as the first self-contained module but with at least one spring with a second spring characteristic that is different than the first spring characteristic; operatively connecting the first self-contained module with the reel so that the drive element and reel are keyed for conjoint rotation around the first axis; and drawing the flexible cord from off of the reel and thereby moving the reel in one direction around the first axis and thereby producing a loading force on the at least one spring that urges the reel in rotation oppositely to the one direction to thereby cause the flexible cord to be wrapped around the reel.

The method may further include the step of connecting the flexible cord to a portable article to be monitored to thereby control movement of the portable article away from the housing.

The method may further include the step of providing an alarm system with a sensor attached to the portable article and electrically connecting the sensor to the alarm system through the flexible cord so that the alarm system is caused to generate a detectable signal in the event that the flexible cord is severed.

The step of operatively connecting the first self-contained module may involve translating the first self-contained module relative to the reel along the first axis to thereby cause the reel and drive element to be keyed for conjoint rotation.

In one form, the housing has joinable first and second parts and further including the step of releasably joining the first and second housing parts to define a main chamber within which the reel and first self-contained module are captively maintained.

The invention is still further directed to a method of forming an apparatus for drawing a flexible cord into a wrapped configuration around a reel. The method includes the steps of: providing a housing with a reel that is movable around a first axis and having a flexible cord wrapped around the reel; determining a spring force characteristic that will cause a desired rotational force to be exerted on the reel in one direction around the first axis, tending to wrap the flexible cord around the reel, in response to the flexible cord being drawn off of the reel in a manner so as to cause the reel to rotate oppositely to the one direction; providing a spring system having a casing, a drive element that can be keyed to the reel to rotate conjointly therewith, and a receptacle for X number of coiled springs in excess of one coiled spring; and placing from 1-X number coiled springs in the receptacles and operatively connecting the from 1-X number coiled springs to cause the desired rotational force to be exerted on the reel in the one direction.

In one form, the case has first and second parts bounding a chamber and the step of providing a spring system involves joining the first and second case parts so that the coiled springs are captively maintained in the chamber between the first and second case parts.

The step of joining the first and second case parts may involve releasably joining the first and second case parts.

In one form, the housing has first and second parts. The method may further including the step of joining the first and second housing parts to define a main chamber in which the spring system is captively maintained between the first and second housing parts.

The method may further include the step of connecting the flexible cord to a portable article so that the portable article is confined in movement relative to the housing by the flexible cord.

The method may further include the steps of providing an alarm system with a sensor attached to the portable article and electrically connecting the sensor to the alarm system through the flexible cord so that the alarm system is caused to generate a detectable signal in the event that the flexible cord is severed.

DETAILED DESCRIPTION OF THE DRAWINGS

Figures 1, 2:
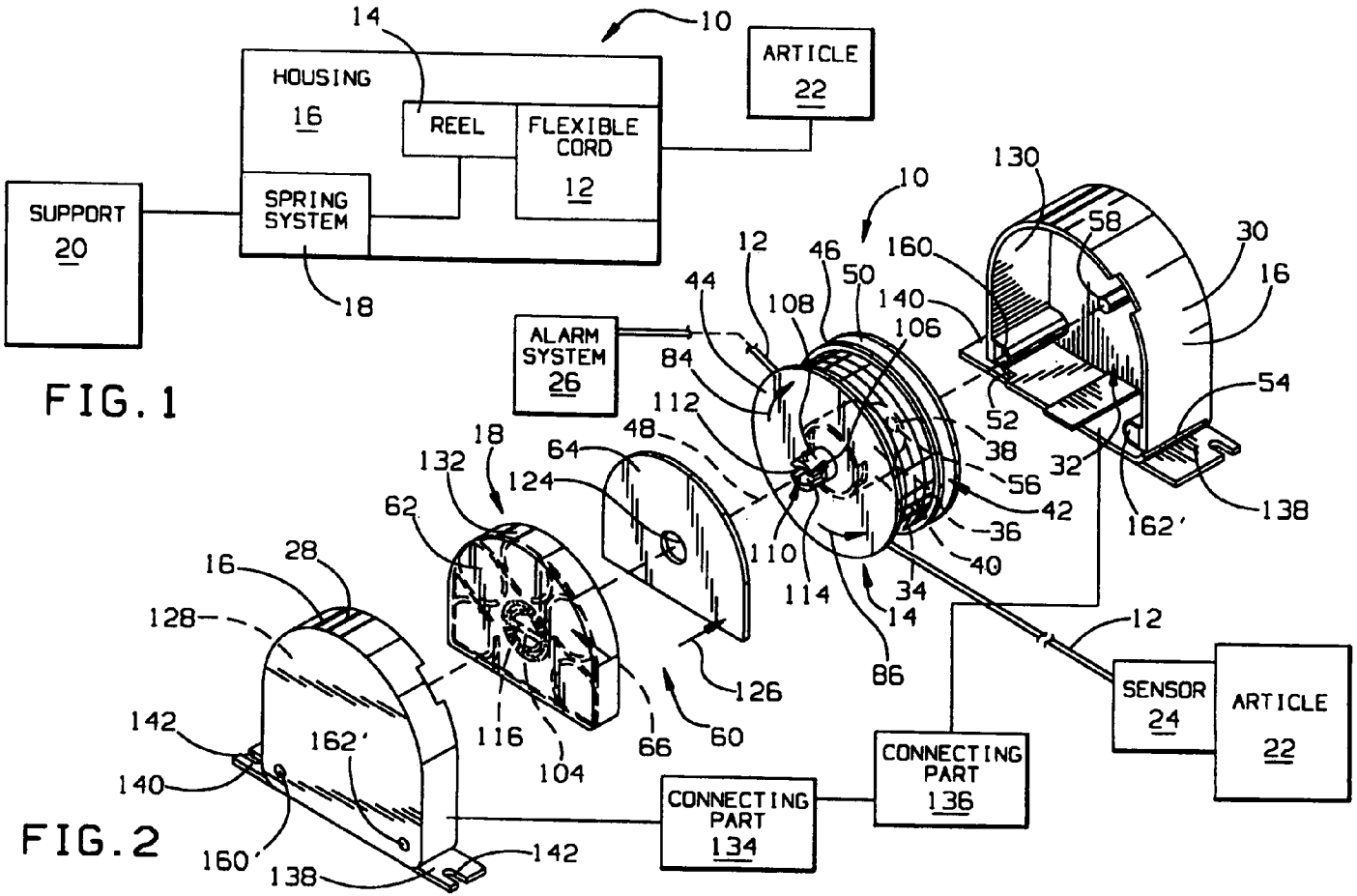
FIG. 1 is a schematic representation of an apparatus for wrapping a cord, according to the present invention, including a housing with a reel with an associated supply of flexible cord that is attached to an article, and wherein a spring system is incorporated to produce a rotational force upon the reel tending to draw paid out flexible cord back into a wrapped configuration on the reel.
FIG. 2 is an exploded perspective view of one specific form of apparatus, as shown in FIG. 1.

In FIG. 1, an apparatus is shown schematically at 10 for drawing flexible cord 12 into a wrapped configuration around a reel 14 that is rotatable around an axis. The apparatus 10 has a housing 16 defining a chamber within which the reel 14 is mounted for movement relative to the housing 16 about an axis. By drawing the flexible cord 12 out of/away from the housing 16, the reel 14 is caused to be turned in one rotational direction around the reel axis. Through a spring system 18, a rotational force is exerted on the reel 14, tending to rotate the reel 14 around the axis thereof in a direction opposite to the one direction, thereby to cause a flexible cord 12 associated with the reel 14 to be wrapped around the reel 14. The spring system 18 permits a user to selectively vary at least one of a) the nature and b) the magnitude of the rotational force exerted on the reel 14 tending to draw the flexible cord 12 back into the housing by wrapping the flexible cord 12 around the reel 14.

The housing 16 can be placed on any appropriate fixed or movable support 20. The housing 16 may be fixed relative to the support 20.

The apparatus 10 may be used in conjunction with any article 22, which is generally portable in nature. While the apparatus 10 is described below in detail in conjunction with an article 22 that is being monitored, as at a point-of-purchase display, the invention is not limited to this particular environment or to any specific type of article. The invention will now be described with respect to this one specific application, which is intended to be exemplary only.

Figure 3:
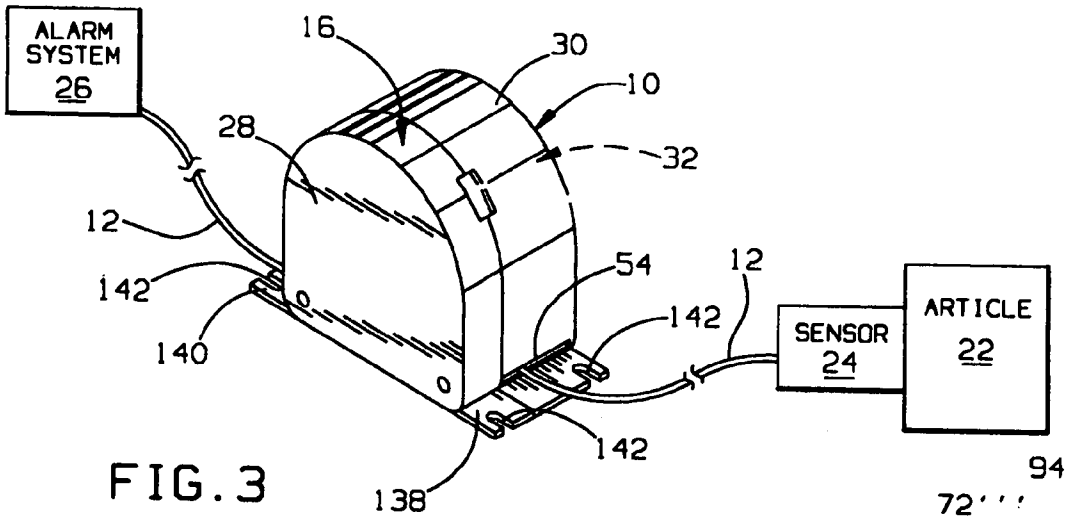
FIG. 3 is a perspective view of the apparatus in FIG. 2 in an assembled state.

In FIGS. 2 and 3, the apparatus 10 is shown with the flexible cord 12 electrically connecting between a sensor 24 and an alarm system 26. The sensor 24 attached to the portable article 22 so that the portable article 22 is restrained in movement relative to the housing 16 within a range dictated by the length of the cable 12 that is extendable from the housing 16. With this arrangement, a continuous conductive path is defined between the sensor 24 and alarm system 26. If the conductive path is interrupted, as by severing the flexible cord 12, the alarm system 26 is caused to generate a detectable alarm signal. The sensor 24 is also configured and connected to the article 22 so that separation of the sensor 24 from the article 22 likewise causes the generation of an alarm signal by the alarm system 26.

The housing 16 consists of first and second joinable parts 28, 30 which, when joined, as in FIG. 3, cooperatively bound a main chamber 32, within which the reel 14 and spring system 18 reside.

In this embodiment, the reel 14 has a stepped diameter hub 34 with a larger diameter portion 36 and a smaller diameter portion 38. The reel 14 has spaced first and second chambers 40, 42, associated respectively with the larger and smaller diameter portions 36, 38 of the hub 34. The first chamber 40 is bounded by walls 44, 46, spaced axially with respect to the hub axis 48. The second chamber 42 is bounded by the wall 46 and a third wall 50, spaced axially from the wall 46.

The flexible cord 12 projects from the second chamber 42 through an opening 52 in the housing part 30 and is from there electrically connected to the alarm system 26. The flexible cord 12 projects from the first chamber 40 through an opening 54 in the housing part 28 to the sensor 24, with which the flexible cord 12 is electrically connected.

The construction of the reel 14 is similar to that disclosed in U.S. Pat. No. Re. 35,247, the disclosure of which is incorporated herein by reference.

The article 22, with the sensor 24 operatively connected thereto, can be repositioned to an extent permitted by the length of the flexible cord 12 within the first chamber 40. As the flexible cord 12 is drawn off of the hub portion 36 and out of the main chamber 32, the reel 14 is caused to rotate around the axis 48. By reason of the diameter of the hub portion 36 being substantially larger than the diameter of the hub portion 38, a single rotation of the reel 14 causes a) a substantial amount of the flexible cord 12, corresponding to the circumference of the hub portion 36, to be drawn out of the housing 16, and b) an insignificant movement of the flexible cord 12 wrapped around the hub portion 38 in the second chamber 42. With this arrangement, the length of the flexible cord 12, extending between the housing 16 and alarm system 26, can be maintained substantially constant while the flexible cord 12 is withdrawn from the first chamber 40 by repositioning the article 22 away from the housing 16.

The reel 14 has an opening 56 in the hub portion 38 which accepts a stub shaft 58 formed integrally with the housing part 30 and projecting into the main chamber 32 bounded by the housing 16. Through this arrangement, the reel 14 is guided in rotation by the stub shaft 58 around the axis 48.

The spring system 18 consists of a self-contained module including, among other elements which will be described below, a case 60, including first and second joinable case parts 62, 64. The case parts 62, 64 cooperatively bound a chamber 66 within which additional spring system components are contained.

Figure 4:
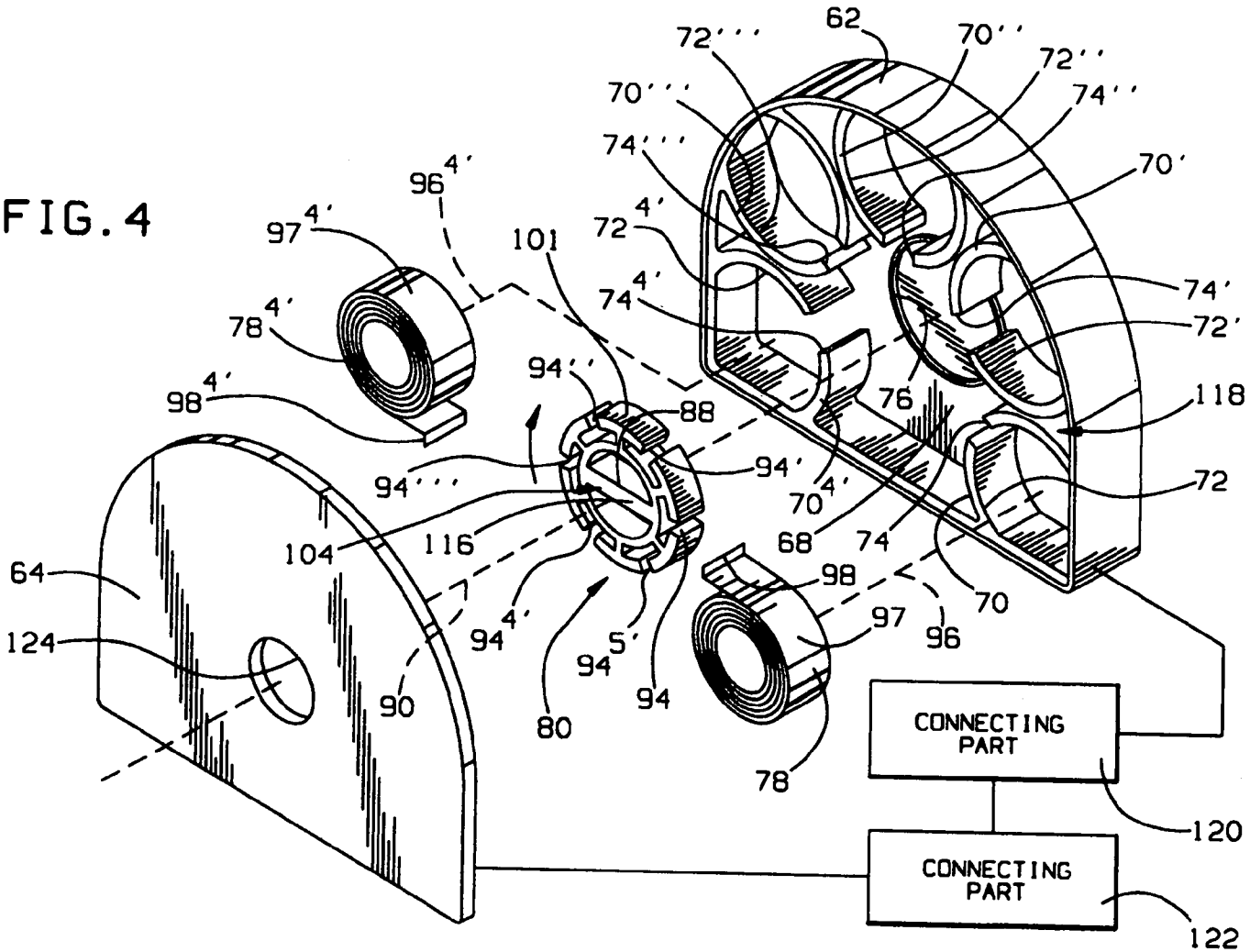
FIG. 4 is an enlarged, exploded perspective view of the spring system on the apparatus in FIG. 2, including two operative coiled springs in a case.

As shown additionally in FIG. 4, the case part 62 functions as a spring support assembly and has a cup-shaped configuration with a generally flat wall surface 68 from which five generally annular walls 70, 70', 70", 70'" and $\mathbf{70}^{4x'}$ project so as to define a like number of discrete receptacles 72, 72', 72", 72'" and $\mathbf{72}^{4x'}$. In actuality, the walls 70 are not continuous in nature. The walls 70, 70', 70", 70'", $\mathbf{70}^{4x'}$ could each be defined by a plurality of discrete, arcuate wall portions or by one substantially continuous wall portion having a spring opening 74, 74', 74", 74'", $\mathbf{74}^{4x'}$. The spring openings 74, 74', 74", 74'", $\mathbf{74}^{4x'}$ communicate, one each, between a receptacle 72, 72', 72", 72'", $\mathbf{72}^{4x'}$ and a central portion of the chamber 66 at which a separate, shallower receptacle 76 is formed.

Each receptacle 72, 72', 72", 72'", $\mathbf{72}^{4x'}$ is designed to accept a single coiled spring, with two such coiled springs 78, $\mathbf{78}^{4x'}$ shown in FIG. 4 aligned for direction into the receptacles 72, $\mathbf{72}^{4x'}$, respectively. The coiled springs 78, 78', 78", 78'", $\mathbf{78}^{4x'}$ can be pre-loaded, but are more preferably loaded initially upon the flexible cord 12 being withdrawn from the reel chamber 40. The loaded coiled springs 78, 78' 78", 78'", $\mathbf{78}^{4x'}$ cooperate with a drive assembly at 80 through which a rotational force is exerted on the reel 14 in the direction of the arrow 84 around the axis 48, opposite to the direction of rotation indicated by the arrow 86 that is caused by drawing the flexible cord 12 from the first chamber 40.

While the drive assembly 80 can be made up of a number of components, in this embodiment, the drive assembly 80 consists of a single drive element 88 that is received within the receptacle 76 and guided therein in rotation relative to the case part 62 around an axis 90.

The drive element 88 has a body 92 with connectors 94, 94', 94", 94'", $\mathbf{94}^{4x'}$, $\mathbf{94}^{5x'}$ spaced equidistantly around the periphery of the body 92. Each connector 94, 94', 94", 94'", $\mathbf{94}^{4x'}$, $\mathbf{94}^{5x'}$ consists of a T-shaped slot, with five of the slots spaced to be alignable one each at the spring openings 74, 74', 74", 74'", $\mathbf{74}^{4x'}$.

Figure 5:
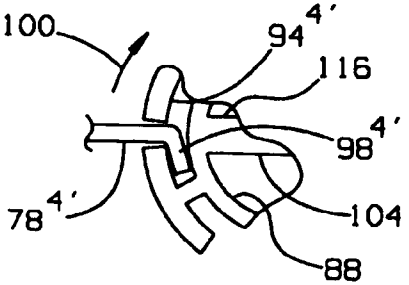
FIG. 5 is an enlarged, fragmentary, elevation view of cooperating connectors on one of the coiled springs and a drive element through which a force from the spring is exerted on the reel.

The springs 78, $\mathbf{78}^{4x'}$ in FIG. 4 are operatively engaged with the drive element 88 by directing the coiled springs 78, $\mathbf{78}^{4x'}$ into their respective receptacles 72, $\mathbf{72}^{4x'}$ by translation along central axes 96, $\mathbf{96}^{4x'}$ about which the strip material 97, $\mathbf{97}^{4x'}$ defining the coiled springs 78, $\mathbf{78}^{4x'}$ is wrapped. At the same time, offset ends 98, $\mathbf{98}^{4x'}$ on the coiled springs 78, $\mathbf{78}^{4x'}$ are directed into the aligned slots 94', $\mathbf{94}^{4x'}$. Further detail of the operative connection of the offset end $\mathbf{98}^{4x'}$ on the coiled spring $\mathbf{78}^{4x'}$ to the drive element 88 is shown in FIG. 5 for the connector/slot $\mathbf{94}^{4x'}$.

As the body 92 is moved in a direction of the arrow 100 around the axis 90, the coiled spring ends 98, $\mathbf{94}^{4x'}$ follow movement thereof to cause the strip material 97, $\mathbf{97}^{4x'}$ to wrap against the outer surface 101 of the body 92. Repeated turning causes successive layers of the strip material 97, $\mathbf{97}^{4x'}$ to be built up upon the outer surface 101. As this occurs, the coiled springs 78, $\mathbf{78}^{4x'}$ become more tightly wound so that there is an increasing restoring force generated therewithin. The restoring force in the coiled springs 78, $\mathbf{78}^{4x'}$ is cumulative.

The drive element 88 is coupled to the reel 14 for conjoint rotation therewith through cooperating connecting parts 104, 106 on the drive element 88 and reel 14, respectively. The connector part 106 is defined on a stub shaft 108 projecting from the wall 44 on the reel 14. The stub shaft 108 has an elongate slot 110 bounded by axially oppositely facing surfaces 112, 114. The hub axis 46 extends through the slot 110, with the slot 110 having a length extending radially oppositely therefrom.

The connector part 104 on the drive element 88 consists of an elongate bar 116 that makes a keyed connection within the slot 110.

To assemble the apparatus 10 of FIG. 4, the coiled springs 78, $\mathbf{78}^{4x'}$ and drive element 88 are pressed into their respective receptacles 72, $\mathbf{72}^{4x'}$ and 76, respectively. The second case part 64 is then joined to the first case part 62 so that the case parts 62, 64 cooperatively bound the chamber 66 within which the drive element 88 and coiled springs 78, $\mathbf{78}^{4x'}$ reside captively between the case parts 62, 64.

The case parts 62, 64 are maintained together by cooperating connecting parts 120, 122, on the case parts 62, 64, respectively, which may effect a permanent or a releasable connection between the case parts 62, 64. As just one example, the connecting parts 120, 122 may snap together. Alternatively, the connecting parts 120, 122 may be one or more fasteners and a receptacle(s) therefor.

Once the case parts 62, 64 are joined, the case parts 62, 64, drive element 88, and coiled springs 78, $\mathbf{78}^{4x'}$ cooperatively define a spring system that is in the form of a self-contained module that can be placed in operative relationship with the reel 14.

To allow the connecting parts 104, 106 to interact and became engaged, an opening 124 is provided through the case part 64 at the location where the bar 116 is situated. The self-contained module can be situated so that the opening 124 aligns with the axis 48, whereupon the self-contained module is translated in the direction of the arrow 126 in FIG. 2 towards the reel 14. As this occurs, the stub shaft 108 passes through the opening 124 to allow the bar 116 to move into the slot 110 whereupon the reel 14 and drive element 88 become keyed together for conjoint rotation about the axis 48. Preferably, no separate fasteners are required to maintain this keyed connection.

In this embodiment, the housing parts 28, 30 have corresponding and matching inside surfaces 128, 130, which cooperatively extend around the periphery of the main chamber 32 and have a non-circular shape. The case part 62 has a peripheral surface 132 that is at least nominally matched in shape to the surfaces 128, 130 so that the case 60 becomes keyed to the housing 16 against rotation relative to the housing 16 about the axis 48 with the apparatus 10 assembled. Through this arrangement, the reel 14 can be rotated around the axis 48 while the case 60 remains stationary, or at least is limited in movement relative to the housing 16, so that the reel 14 will effect loading of the coiled springs 78, $\mathbf{78}^{4x'}$ as the flexible cord 12 is withdrawn.

The housing parts 28, 30 are joined and maintained together by cooperating connecting parts associated with the housing parts 28, 30, respectively. The connecting parts 134, 136 can effect a permanent connection, but are more preferably releasable in nature. The nature of the connecting parts 120, 122, previously described, and the connecting parts 134, 136, is such that they may take any of myriad different forms known to those skilled in the art. With the housing parts 28, 30 joined, the self-contained module defining the spring system 18 and the reel 14 are captively maintained in an operative relationship within the main chamber 32.

In this embodiment, the housing 16 has oppositely projecting flanges 138, 140 with openings 142 therethrough to accept fasteners (not shown) through which the housing 16 can be suitably secured to the support 20.

Figure 6:
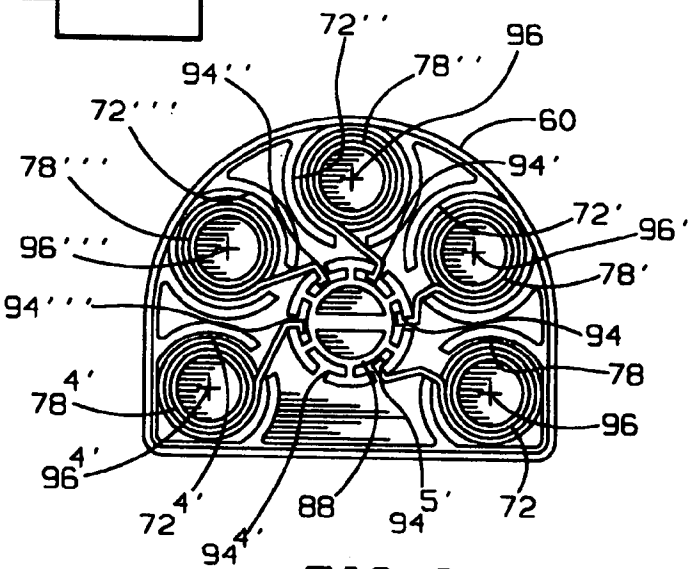
FIG. 6 is an elevation view of one part on the case in FIG. 4 with five coil springs operatively connected to the drive element.

While the invention is depicted in FIG. 4 using two coiled springs 78, $\mathbf{78}^{4x'}$, the invention contemplates a generic construction for the case 60 that allows in this embodiment the selective use of one to five coiled springs, with all five 78, 78', 78", 78'", $\mathbf{78}^{4x'}$ shown in place in the receptacles 94, 94', 94", 94'", $\mathbf{94}^{4x'}$ and operatively connected to the drive element 88 in FIG. 6. All of the springs 78, 78', 78", 78'", $\mathbf{78}^{4x'}$ are pressed into their associated receptacle 72, 72', 72", 72'", $\mathbf{72}^{4x'}$ along axes 96, 96', 96", 96'", $\mathbf{96}^{4x'}$. The invention contemplates that any number X of coiled springs could be accommodated and used in any combination or number, from 1-X. All operative springs wrap simultaneously around the drive element 88 as it is moved around the axis 90.

With this arrangement, at the point of manufacture, or at the point of end use, the desired number of coiled springs 78, 78', 78", 78'", $\mathbf{78}^{4x'}$ can be placed in their associated receptacles 72, 72', 72", 72'", $\mathbf{72}^{4x'}$ and any or all operatively connected to the drive element 88 to select the spring characteristics, which may vary by reason of their nature or magnitude.

Figure 7:
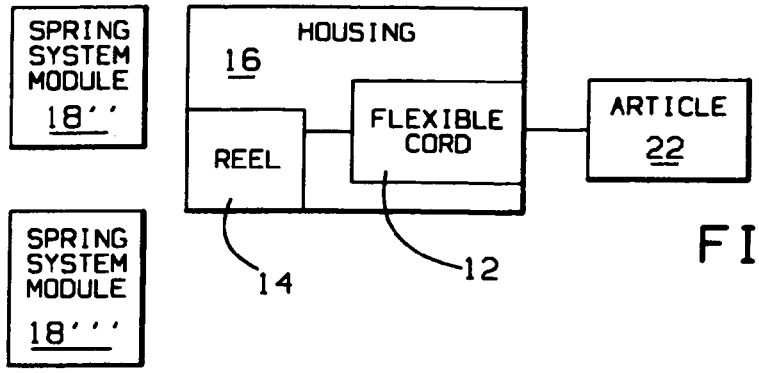
FIG. 7 is a schematic representation of a kit, including the aforementioned housing with the reel and flexible cord, and two spring system modules that can be selectively, interchangeably, operatively engaged with the reel.

Alternatively, as shown in FIG. 7, rather than reconfiguring the individual modules, spring system modules 18" and 18'" may be pre-assembled and available for selective use at the point that the apparatus 10 is assembled. The spring system modules 18", 18'" have spring characteristics that are different by reason of the nature and/or magnitude of rotational force that is developed as the associated reel 14 is rotated to withdraw the flexible cord 12. The user can select the desired spring system module 18", 18'" and effect installation of the appropriate spring system module for the particular application.

Figure 8:
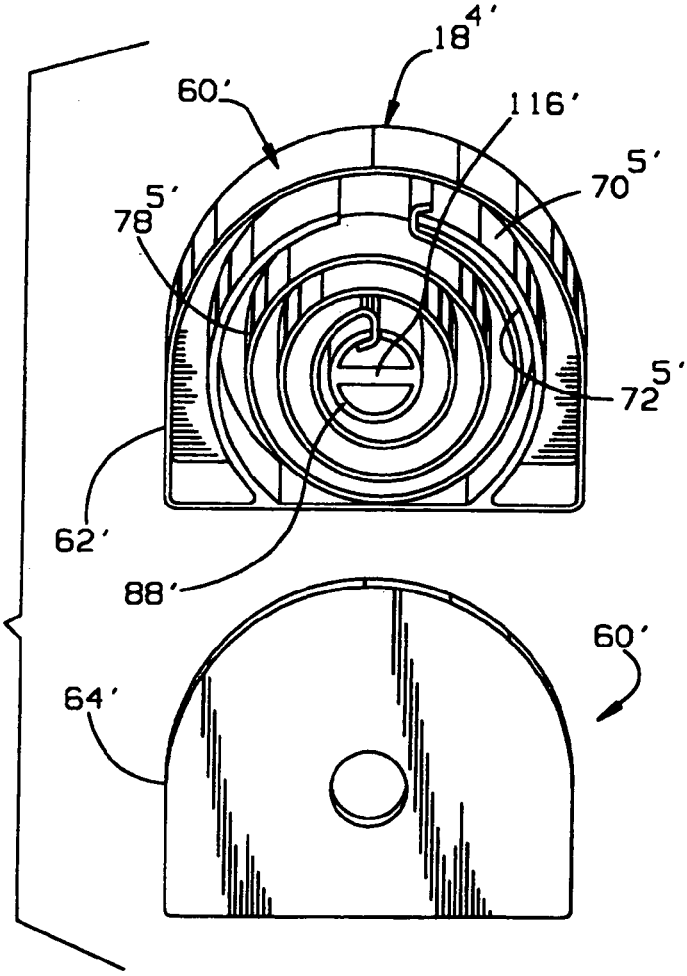
FIG. 8 is an exploded perspective view of a modified form of a spring system module, including a single coiled spring within a case.

The spring system modules 18", 18'" do not have to have the configuration shown in FIGS. 4 and 6. For example, a spring system module is shown at $\mathbf{18}^{4x'}$ in FIG. 8 and consists of a case 60' with a first case part 62' and a second case part 64', corresponding to the base parts 62, 64, previously described. In this embodiment, the case part 62' has a single annular wall $\mathbf{70}^{5x'}$ defining a receptacle $\mathbf{72}^{5x'}$ for a single coiled spring $\mathbf{78}^{5x'}$ which is operatively connected to a drive element 88' having an elongate bar 116' to be keyed in the slot 110 on the reel 14.

Figure 9:
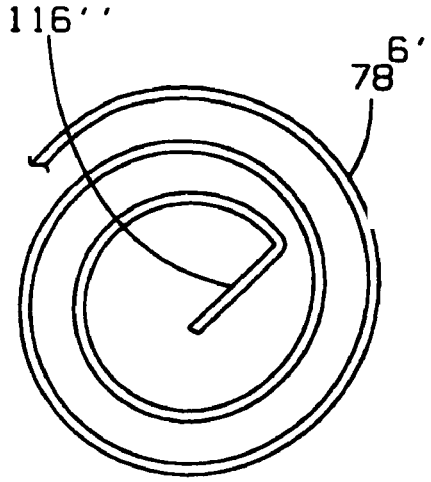
FIG. 9 is a fragmentary, elevation view of a connecting part that is integral with a coiled spring for operative connection to the reel.

As shown in FIG. 9, as an alternative to providing separate drive elements 88, 88', an end of a coiled spring $\mathbf{78}^{6x'}$ can be bent so as to define an integrally formed elongate bar 116", which performs the function of the elongate bars 116, 116' on the drive elements 88, 88'.

While in FIGS. 2-4 the apparatus 10 has been described in an electrical security system, the apparatus 10 shown in FIG. 1 is intended to represent more generically any system in which a flexible cord 12 is associated with an article 22, be it purely a mechanical connection, an electrical connection, or electro-mechanical in nature.

Figure 10:
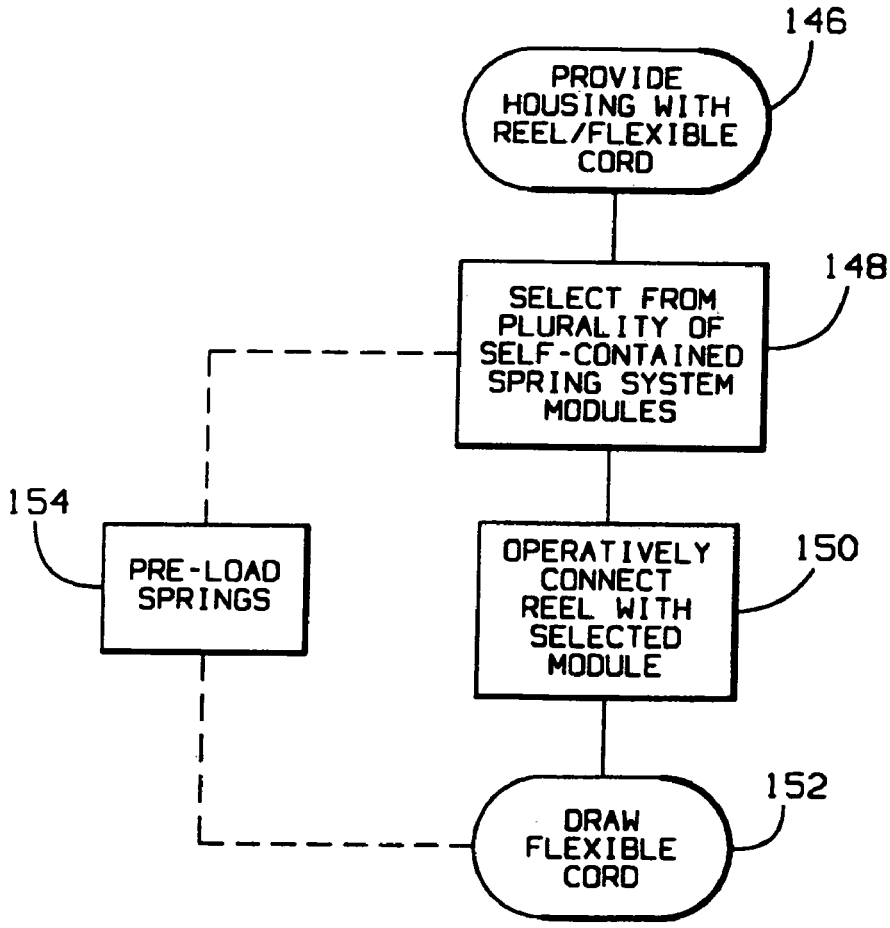
FIG. 10 is a flow diagram representation of one method of forming an apparatus for drawing a flexible cord into a wrapped configuration around a reel, according to the present invention.

With the inventive structure, the manufacturer and/or user has significant flexibility in terms of selecting performance characteristics for the apparatus. As shown in FIG. 10 in flow diagram form, a generic, base subcombination consisting of the housing and reel/flexible cord can be provided as shown at block 146. As shown at block 148, the user selects a self-contained spring system module that affords the desired spring characteristics from a plurality of different spring system modules. The selection process may involve choosing between different pre-formed modules or of reconfiguring the module starting with the generic case.

As shown at block 150, the selected module can then be operatively connected with the reel, which remains operatively assembled to the housing, after which the flexible cord can be drawn from the housing to load or further load the spring(s) associated with the selected module, as shown at block 152.

As shown at block 154, the spring or springs can be optionally preloaded in the module preparatory to installation thereof.

The apparatus 10 may be made so that it can be disassembled and re-assembled or reconfigured for reuse in the same, or for a different, application.

While the spring systems are shown with the same spring configuration in FIGS. 2-6 and 8, the springs in the generic spring system 18, 18", 18'" in FIGS. 1 and 7 may be offered with different types/natures of springs. For example constant force or variable force springs may be selected.

Figure 11:
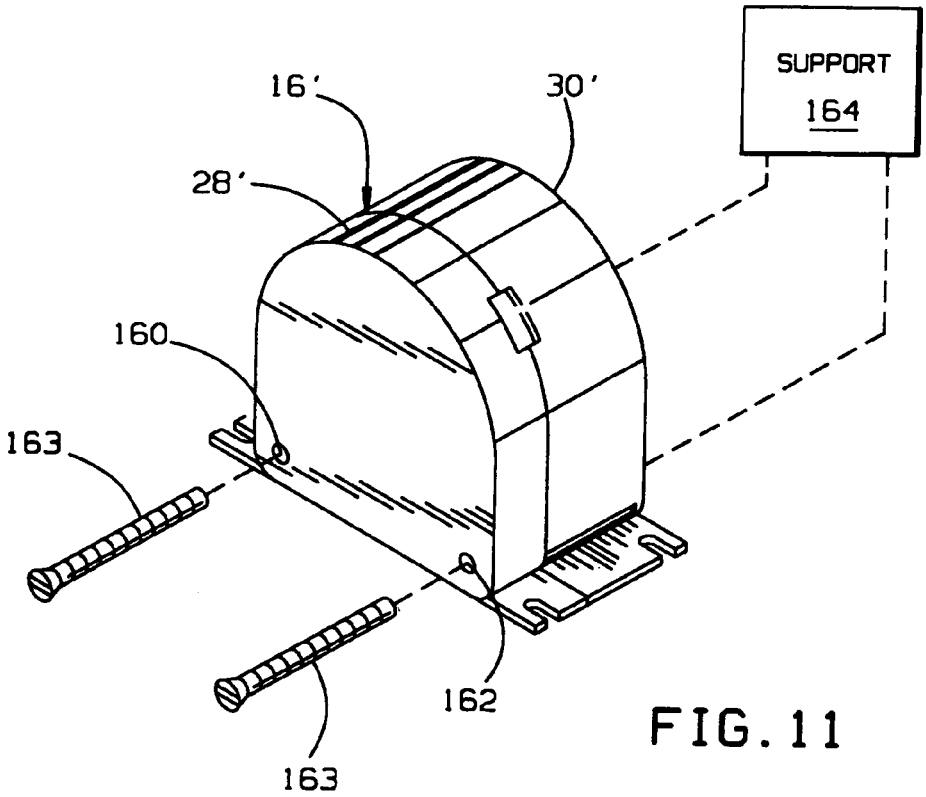
FIG. 11 is a perspective view of a modified form of housing, corresponding to that in FIG. 1, with a different structure for mounting the housing than shown in FIG. 1.

In one modified form, the flanges 138, 140 are omitted. More particularly, as shown in FIG. 11, housing parts 28', 30', corresponding to the housing parts 28, 30 and defining a housing 16', have through holes 160, 162 to accept threaded fasteners 163 that can be directed through the joined housing parts 28', 30' into a suitable support 164. The remaining functional components, previously described, can be incorporated into the housing parts 28', 30' in the same manner that they are incorporated into the housing parts 28, 30.

As shown in FIG. 2, like through holes 160', 162' could be incorporated into the housing 16 to be selectively used in conjunction with, or as an alternative to, the openings 142 in the flanges 138, 140 to accept appropriate fasteners.

Figure 12:
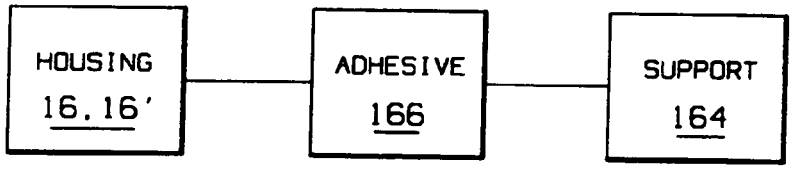
FIG. 12 is a schematic representation of a still further modified structure for mounting the housing and including an adhesive.

Alternatively, as shown schematically in FIG. 12, an adhesive 166, which may be a double-sided adhesive tape, or the like, can be used to maintain the housing 16, 16' operatively associated with the support 164.

The foregoing disclosure of specific embodiments is intended to be illustrative of the broad concepts comprehended by the invention.

The invention claimed is:

1. A kit for providing a reconfigurable apparatus for drawing a flexible cord into a wrapped configuration around a reel, the kit comprising:

a housing;

a reel that is movable around a first axis relative to the housing with the reel operatively assembled to the housing; and a spring system through which a rotational force is exerted on the reel tending to rotate the reel around the first axis to thereby cause a flexible cord associated with the reel that is drawn away from the housing by turning of the reel in one direction around the first axis to be wrapped around the reel by turning of the reel oppositely to the one direction around the first axis, the spring system having a configuration that is changeable by a user, thereby permitting a user to selectively vary at least one of a) the nature and b) the magnitude of the rotational force exerted on the reel, wherein the spring system comprises first and second spring modules that can be interchangeably mounted on the housing in operative relationship with the reel, the first and second spring modules having different spring force characteristics, the first and second spring modules each separable as a unit from the housing and reel and mountable to the housing, one in place of the other, with the reel remaining operatively assembled to the housing.

2. A kit for providing a reconfigurable apparatus for drawing a flexible cord into a wrapped configuration around a reel according to claim 1 in combination with a flexible cord that is associated with the reel, wherein the first and second spring modules are mountable to and separable from the housing and reel without requiring any reconfiguration of the reel.

3. The kit for providing a reconfigurable apparatus for drawing a flexible cord into a wrapped configuration around a reel according to claim 2 further in combination with a connector on the flexible cord that can be attached to an article to be restrained in movement relative to the housing by the flexible cord.

4. The kit for providing a reconfigurable apparatus for drawing a flexible cord into a wrapped configuration around a reel according to claim 2 further in combination with an alarm system and a sensor that is attachable to a portable article to be monitored, the flexible cord defining a conductive path between the sensor and the alarm system, and the alarm system is caused to generate a detectable alarm signal in the event that the conductive path is interrupted.

5. The kit for providing a reconfigurable apparatus for drawing a flexible cord into a wrapped configuration around a reel according to claim 4 in combination with an article and the sensor is connected to the article so that disconnection of the sensor from the article causes the alarm system to generate a detectable alarm signal.

6. The kit for providing a reconfigurable apparatus for drawing a flexible cord into a wrapped configuration around a reel according to claim 4 wherein the reel comprises two chambers, and the flexible cord extends from the first chamber through the housing and to the sensor and the flexible cord extends from the second chamber to the alarm system.

7. The kit for providing a reconfigurable apparatus for drawing a flexible cord into a wrapped configuration around a reel according to claim 1 wherein the first spring module comprises a spring support assembly that is mounted on the housing in operative relationship with the reel, the spring support assembly accommodating a plurality of springs that can be selectively operatively engaged to cause the spring system to exert a desired rotational force upon the reel.

8. The kit for providing a reconfigurable apparatus for drawing a flexible cord into a wrapped configuration around a reel according to claim 7 wherein the springs in the plurality of springs are coiled springs, the spring support assembly comprises X number receptacles, each for one of the plurality of coiled springs, and the spring system further comprises a drive assembly that causes a rotational force developed by one or more coiled springs in the receptacles to be exerted on the reel.

9. The kit for providing a reconfigurable apparatus for drawing a flexible cord into a wrapped configuration around a reel according to claim 8 wherein the spring system comprises a self-contained module including the drive assembly that comprises a drive element that rotates around the first axis to cause a rotational force developed by the one or more coiled springs in the receptacles to be exerted on the reel and selectively X number coiled springs or from 1-X number coiled springs can each be operatively engaged by connection directly to the drive element.

10. The kit for providing a reconfigurable apparatus for drawing a flexible cord into a wrapped configuration around a reel according to claim 7 wherein the spring support assembly comprises a case comprising first and second joined parts bounding a chamber, there is an opening through the case, the spring system further comprises a coiled spring and a drive assembly including a drive element that is keyed to the reel through the case opening for conjoint rotation therewith around the first axis, and the coiled spring and drive element are captively located in the chamber between the first and second case parts.

11. The kit for providing a reconfigurable apparatus for drawing a flexible cord into a wrapped configuration around a reel according to claim 10 wherein the housing comprises first and second joined parts bounding a main chamber and the reel and case reside in the main chamber and are captive between the first and second housing parts.

12. The kit for providing a reconfigurable apparatus for drawing a flexible cord into a wrapped configuration around a reel according to claim 10 wherein the case, coiled spring, and drive assembly are part of a self-contained module that is mounted on the housing in operative relationship with the reel, the case comprising first and second case parts between which the coiled spring is captively located.

13. The kit for providing a reconfigurable apparatus for drawing a flexible cord into a wrapped configuration around a reel according to claim 12 wherein the self-contained module is releasably mounted in operative relationship with the reel by moving the self-contained module along the first axis relative to the reel.

14. The kit for providing a reconfigurable apparatus for drawing a flexible cord into a wrapped configuration around a reel according to claim 7 wherein the housing comprises first and second joined parts bounding a main chamber and the reel and support assembly reside in the main chamber and are captive between the first and second housing parts.

15. An apparatus for drawing a flexible cord into a wrapped configuration around a reel, the apparatus comprising:

a housing;

a reel that is movable around a first axis relative to the housing; and a spring system through which a rotational force is exerted on the reel tending to rotate the reel around the first axis to thereby cause a flexible cord associated with the reel that is drawn away from the housing by turning of the reel in one direction around the first axis to be wrapped around the reel by turning of the reel oppositely to the one direction around the first axis, the spring system having a configuration that is changeable by a user, thereby permitting a user to selectively vary at least one of a) the nature and b) the magnitude of the rotational force exerted on the reel, wherein the spring system is in the form of a self-contained module that is separable as a unit from the reel and comprises a spring support assembly that is mounted on the housing in operative relationship with the reel, the spring support assembly accommodating a plurality of springs that can be selectively operatively engaged to cause the spring system to exert a desired rotational force upon the reel, wherein the springs in the plurality of springs are coiled springs, the spring support assembly comprising X number receptacles, each for one of the plurality of coiled springs, wherein the spring system further comprises a drive assembly that causes a rotational force developed by one or more coiled springs in the receptacles to be exerted on the reel, wherein the spring support assembly comprises X number generally annular walls disposed around the first axis, each defining a receptacle to receive a coiled spring, and the drive assembly comprises a drive element that moves around the first axis and is keyed to the reel to transmit a rotational force to the reel.

16. The apparatus for drawing a flexible cord into a wrapped configuration around a reel according to claim 15 wherein the reel and drive element have cooperating parts that can be engaged to make a keyed connection between the reel and drive element without requiring any separate fasteners.

17. The apparatus for drawing a flexible cord into a wrapped configuration around a reel according to claim 16 wherein the reel and drive element are engaged by being relatively moved in translation along the first axis without changing a configuration of the reel.

18. The apparatus for drawing a flexible cord into a wrapped configuration around a reel according to claim 15 wherein the drive element has a body with a first connector and the spring system comprises a first coiled spring in one of the receptacles having an end that is joined to the first connector to follow movement of the drive element around the first axis to thereby effect loading of the first coiled spring.

19. The apparatus for drawing a flexible cord into a wrapped configuration around a reel according to claim 18 wherein the drive element body has a second connector, the spring system further comprises a second coiled spring in another of the receptacles and having an end that is joined to the second connector to follow movement of the drive element around the first axis.

20. The apparatus for drawing a flexible cord into a wrapped configuration around a reel according to claim 18 wherein the end of the first coiled spring is joined to the first connector by translating the end of the first coiled spring relative to the first connector along the first axis into a discrete receptacle.

21. An apparatus for drawing a flexible cord into a wrapped configuration around a reel, the apparatus comprising:

a housing;

a reel that is movable around a first axis relative to the housing; and a spring system through which a rotational force is exerted on the reel tending to rotate the reel around the first axis to thereby cause a flexible cord associated with the reel that is drawn away from the housing by turning of the reel in one direction around the first axis to be wrapped around the reel by turning of the reel oppositely to the one direction around the first axis, the spring system comprising a first self-contained module comprising a case with an opening and a drive element movable around a second axis relative to the case, the case configured to accept at least first and second springs that are each directly connected to the drive element and through which a rotational force can cooperatively be exerted on the drive element to urge the drive element in movement around the second axis relative to the case, wherein the first self-contained module can be moved relative to and seperable as a unit from the housing to make a keyed connection through the case opening between the drive element and reel without requiring changing of a configuration of the reel.

22. The apparatus for drawing a flexible cord into a wrapped configuration around a reel according to claim 21 wherein the housing comprises first and second joinable parts that define a main chamber when joined, and the first self-contained module is captive between the first and second parts.

23. The apparatus for drawing a flexible cord into a wrapped configuration around a reel according to claim 21 wherein the first self-contained module and reel are relatively movable along a line that is substantially parallel to the first and second axes to make a keyed connection between the drive element and reel.

24. The apparatus for drawing a flexible cord into a wrapped configuration around a reel according to claim 21 wherein the first self-contained module comprises first and second case parts that are joined to define a chamber within which the at least one spring and drive element are captively maintained between the first and second case parts.

25. The apparatus for drawing a flexible cord into a wrapped configuration around a reel according to claim 21 wherein the self-contained module has a plurality of discrete receptacles each to receive a coiled spring that can be operatively connected to the drive element.

26. The apparatus for drawing a flexible cord into a wrapped configuration around a reel according to claim 25 wherein there are X number receptacles, the drive element can be operatively connected directly to X number coiled springs and there are from 1-x number coiled springs directly operatively connected to the drive element.

27. The apparatus for drawing a flexible cord into a wrapped configuration around a reel according to claim 21 wherein there is a second self-contained module like the first self-contained module and the first and second self-contained modules can be interchangeably used to be operative with the reel.

28. The apparatus for drawing a flexible cord into a wrapped configuration around a reel according to claim 27 wherein the first and second self-contained modules have spring force characteristics that are different to thereby cause the at least one spring in the first self-contained module to cause a rotational force to be exerted on the reel that is different in at least one of a) nature and b) magnitude than a rotational force exerted on the reel by at least one spring in the second self-contained module.

29. The apparatus for drawing a flexible cord into a wrapped configuration around a reel according to claim 27 wherein the housing has releasably joined first and second parts bounding a main chamber in which the operative reel resides.

30. The apparatus for drawing a flexible cord into a wrapped configuration around a reel according to claim 21 in combination with a flexible cord that is associated with the reel.

31. The apparatus for drawing a flexible cord into a wrapped configuration around a reel according to claim 30 further in combination with a connector on the flexible cord that can be attached to an article to be restrained in movement relative to the housing by the flexible cord.

32. The apparatus for drawing a flexible cord into a wrapped configuration around a reel according to claim 30 further in combination with an alarm system and a sensor that is attachable to a portable article to be monitored, the flexible cord defining a conductive path between the sensor and the alarm system, and the alarm system is caused to generate a detectable alarm signal in the event that the conductive path is interrupted.

33. The apparatus for drawing a flexible cord into a wrapped configuration around a reel according to claim 32 in combination with an article and the sensor is connected to the article so that disconnection of the sensor from the article causes the alarm system to generate a detectable alarm signal.

34. The apparatus for drawing a flexible cord into a wrapped configuration around a reel according to claim 32 wherein the reel comprises two chambers, and the flexible cord extends from the first chamber through the housing and to the sensor and from the second chamber to the alarm system.

35. A kit for providing a reconfigurable apparatus for drawing a flexible cord into a wrapped configuration around a reel, the apparatus comprising:

a housing;

a reel that is movable around a first axis relative to the housing; and a spring system comprising a self-contained module that is separable as a unit from the reel and through which a rotational force is exerted on the reel tending to rotate the reel around the first axis to thereby cause a flexible cord associated with the reel that is drawn away from the housing by turning of the reel in one direction around the first axis to be wrapped around the reel by turning of the reel oppositely to the one direction around the first axis, the spring system having a configuration that is changeable by a user, thereby permitting a user to selectively vary at least one of a) the nature and b) the magnitude of the rotational force exerted on the reel, wherein the spring system comprises a spring support assembly that is mounted on the housing in operative relationship with the reel, the spring system further comprising a plurality of springs, the spring support assembly accommodating the plurality of springs and configured to allow selective operative engagement of different numbers of the plurality of springs to cause the spring system to exert different desired rotational forces upon the reel.

* * * * *